United States Patent [19]

Roggenkamp

[11] 4,132,128

[45] Jan. 2, 1979

[54] ACTUATING MECHANISM

[75] Inventor: George H. Roggenkamp, Salem, Va.

[73] Assignee: Eaton Corporation, Cleveland, Ohio

[21] Appl. No.: 846,297

[22] Filed: Oct. 28, 1977

[51] Int. Cl.[2] ..... G05G 5/06; H01H 13/28

[52] U.S. Cl. ..... 74/527; 74/97; 200/67 B; 200/67 G; 200/335

[58] Field of Search ..... 74/97, 527; 200/67 R, 200/67 DA, 67 B, 67 G, 153 H, 332, 335, 291

[56] References Cited

U.S. PATENT DOCUMENTS

| | | | |
|---|---|---|---|
| 2,780,691 | 2/1957 | Landin | 74/97 X |
| 3,157,759 | 11/1964 | Kudalis | 200/67 B |
| 3,569,655 | 3/1971 | Jakubauskas | 200/67 G X |
| 3,673,368 | 6/1972 | Howe et al. | 200/67 G |

*Primary Examiner*—Allan D. Herrmann
*Attorney, Agent, or Firm*—Frank M. Sajovec, Jr.

[57] ABSTRACT

An actuating mechanism having three detented actuating positions. The actuating mechanism includes an arm having a roller rotatably mounted thereon. The roller bears against the sides of two juxtaposed coil springs which bias the arm into a neutral position when the roller is received between the springs, and an actuated position on either side of neutral when the roller rides past the centerline of one or the other of the springs. In accordance with one aspect of the invention, directional switches are actuated by the arm when the arm is moved to either side of neutral.

13 Claims, 3 Drawing Figures

ACTUATING MECHANISM

PRIOR ART STATEMENT

A search of the prior art has yielded no references considered by the Applicant to be relevant to his invention. Specifically, no references were found suggesting a detent assembly wherein a roller deflects a coil spring transversely with respect to the coil axis.

This invention relates to actuating mechanisms, and more particularly to a mechanism providing three detented actuation positions, which is particularly adapted for use in an electrical direction controller.

There are many applications for the type of actuating mechanism which provides three distinct operating positions, generally a neutral position and an operating position on either side of neutral. For example, in material handling applications, all electric vehicles require a vehicle direction controller having neutral, forward and reverse positions. Another common use for such a device as in direct and remote valve controls to provide, for example, lift, neutral and lower positions for a hydraulic control valve controlling the load carriage of an industrial vehicle.

When used in industrial applications, such actuators must be very reliable and rugged while providing positive and accurate positioning. As a result the prior art devices heretofore available have generally been complex and expensive.

It is, therefore, an object of the present invention to provide a multiple position actuating mechanism which is simple and inexpensive to construct while providing accurate and reliable positioning.

Another object of the invention is to provide an actuating mechanism, as above, providing a detented neutral position and detented actuating positions on either side of neutral.

Another object of the invention is to provide an actuating mechanism as above, which is particularly adapted for use as an electrical switch actuating mechanism.

The present invention provides an actuating mechanism including a pivotally mounted arm member having a roller attached at one end, the roller being in contact with a pair of juxtaposed coil springs. The axis of rotation of the roller is parallel to the axes of the springs, and the space relationship of the roller to the springs is such that with the actuating arm in the neutral position, both of the springs exert a force on the roller tending to maintain the roller between the springs, and with the actuating arm in one of the two actuated positions, one or the other of the springs acts as an over-center device to bias the roller to its actuated position. Another portion of the arm member is formed to engage one or more switches or the like in one or more of the three detented positions.

Other objects and advantages of the invention will become more apparent from the following description when taken in connection with the accompanying drawings, wherein FIG. 1 is a side elevation view of the invention;

Figure 1:
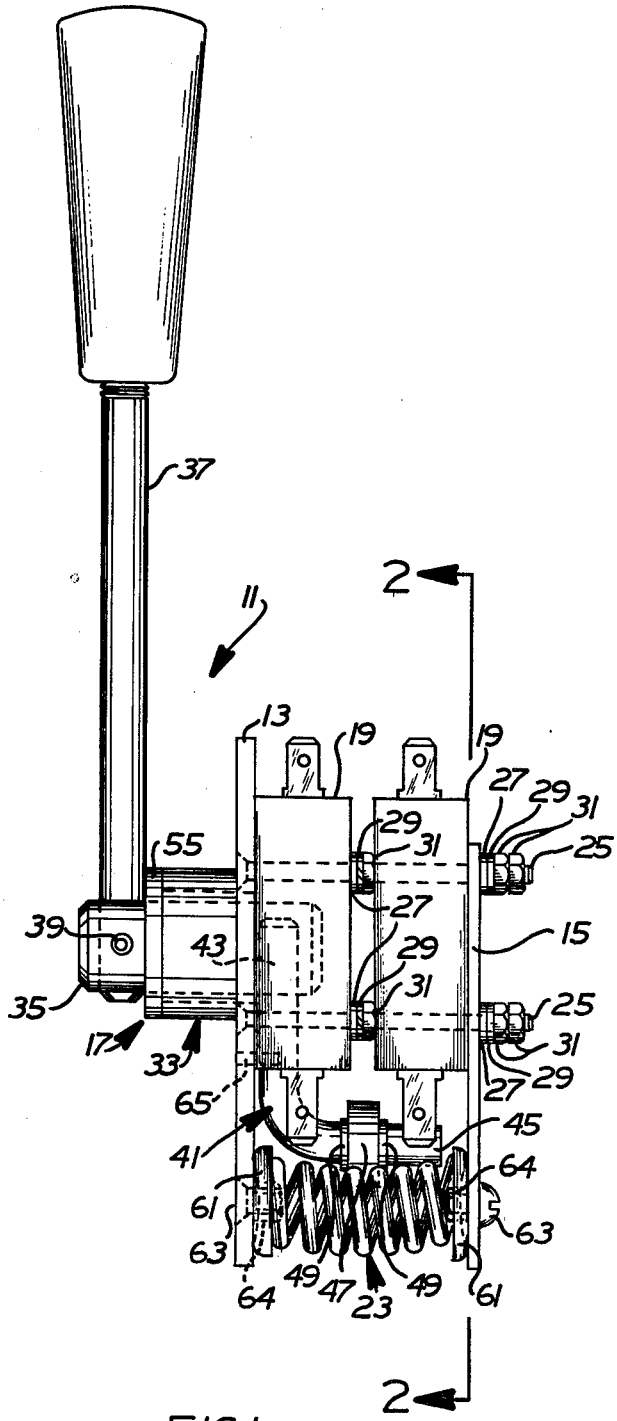

Referring to FIG. 1, there is illustrated a direction controller for an electrically powered industrial vehicle. In some types of trucks a plurality of switch contacts must be closed to put the vehicle in its forward and reverse travel modes. For purposes of illustration the embodiment disclosed herein includes a plurality of momentary contact switches which will be referred to hereinafter as forward direction switches and reverse direction switches, the actual circuitry associated with the switches being conventional and forming no part of the present invention.

The controller, designated generally by the numeral 11, comprises a first frame member 13; a second frame member 15 spaced from the first frame member; a control arm assembly 17 mounted on the first frame member 13; a pair of forward direction switches 19, and a pair of reverse direction switches 21 (only one of which is shown) received between the frame members 13 and 15; and a spring detent assembly 23.

The frame members 13 and 15 are spaced apart by the switches 19 and 21, which are attached to the frame members by long screws 25 extending through holes formed in the switch bodies and through the frame members. For example, referring to FIG. 1, a pair of screws 25 extends through a first switch 19 and secures the switch to the frame member 13 by means of a flat washer 27, a lock washer 29, and a nut 31. The screw 25 extends further through the second switch 19, and frame member 15, and a similar washer and nut combination is applied to secure the switches and frame members as a unit. An additional nut 31 is applied to each screw outside the frame member 15 to act as a locknut. A plurality of holes 32 are provided in the frame member 13 for mounting the controller to a vehicle frame member.

The control arm assembly 17 comprises a journal assembly 33 which is pressed into a hole formed in the frame member 13 between the pairs of switches, a shaft 35 received in a bore formed in the journal assembly 33, an operator-actuated control arm 37 received in a transverse hole formed in one end of the shaft 35 and pinned thereto at 39, and an actuating arm 41 received in a transverse hole formed in the opposite end of shaft 35 and press fit or otherwise secured therein.

The actuating arm 41 comprises a first leg 43 pressed into the shaft 35, a second leg 45 bent at a right angle to the first leg and extending substantially parallel to the shaft 35, and a detent roller 47 mounted for rotation on the central portion of the second leg and retained thereon by snap rings 49. The actuating arm 41 is arranged relative to the switches such that the arm is engageable with switch actuating leaves 51, which are pivotally attached to the body of each switch and which engage button actuators 53 to close or open the switch depending on whether it is a normally open or a normally closed type switch. To provide smooth operation of the controller, the shaft 35 is received in a shouldered, oil-impregnated bearing 55, which is pressed into the journal member 33.

The spring detent assembly 23 comprises a first coil spring 57 and a second coil spring 59 mounted side by side between the frame members 13 and 15, with their axes parallel to shaft 35.

Each of the springs 57 and 59 are retained by opposed cap members 61 which are coaxially disposed and attached to the inner faces of frame members 13 and 15 by means of screws 63 and nuts 64. Preferably, the length of each spring 57 and 59 is selected such that it is compressed when it is received between the caps.

Figure 2:
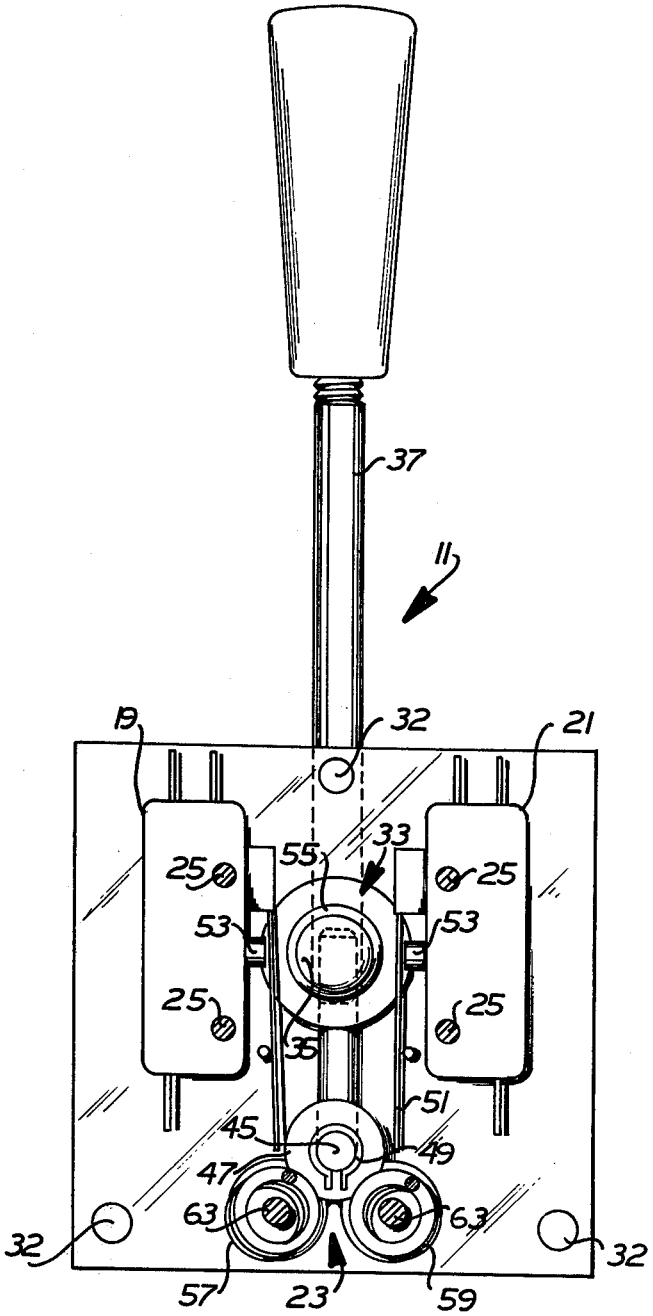
FIG. 2 is a section view taken along line 2—2 of FIG. 1.

The detent springs 57 and 59 are positioned relative to the actuating arm 41, and the detent roller is sized such that when the control arm 34 is centered, as shown in FIG. 2, the detent roller 47 is received between the springs 57 and 59 and exerts a downward force on the springs, deflecting them laterally away from their coil axes in their undeflected state, tending to spread them apart. The springs thus exert a centering reaction force on the detent roller tending to maintain the control arm assembly 17 in the position shown in FIG. 2. In this condition the switch actuating leaves 51 are out of contact with the actuating arm 41.

Figure 3:
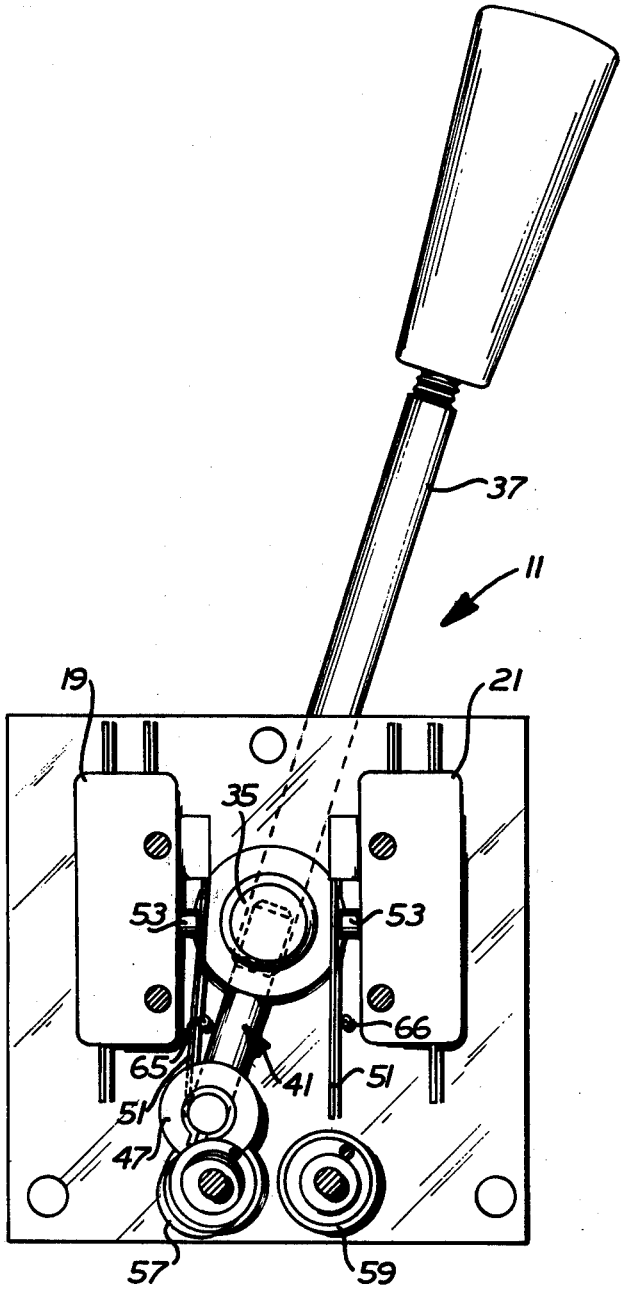
FIG. 3 is a view similar to FIG. 2, showing the invention in a different operating position.

Referring to FIG. 3, when it is desired to actuate the forward direction switches 19, the control arm 37 is moved to the right as viewed in FIG. 3, rotating the shaft 35 clockwise, and moving actuating arm 41 to the left, overcoming the centering force of spring 57. As the detent roller 47 rolls along the coils of the spring 57, it will, by nature of the spatial relationships discussed above, continue to deflect spring 57 to provide sufficient resistance to movement to allow the controller to provide a good "feel" to the operator. Once the roller has roller around the spring to a point where the roller axis is over center with respect to the coil axis, the reaction force of the spring will be acting on the detent roller in a direction tending to rotate the actuating arm 41 to the left as shown in FIG. 3. A stop pin 65, pressed into first frame member 13 and extending therefrom in position to engage actuating arm 41, limits travel of the control arm in either direction of actuation.

As the actuating arm 41 approaches its FIG. 3 position, it will contact and deflect the actuating leaves 51 associated with forward direction switches 19, which in turn will depress the respective button actuators 53 to actuate the switches. As the roller 47 passes over center with respect to the axis of coil spring 57, the spring will bias the arm 41 leftward against the stop 65. The control arm 37 will thus be maintained in the position of FIG. 3 until sufficient force is applied in the opposite direction to overcome the force of spring 57 acting against the roller 47.

Upon movement of the control arm 37 to the left as viewed in FIG. 3, spring 59 and a stop pin 66 produce the same detent action as described above, while reverse direction switches 21 are actuated by actuating arm 41 contacting the leaves 51 associated with the switches 21.

I claim:

1. A control apparatus comprising a frame member, a control arm mounted for rotary movement on said frame member, and a detent assembly for holding said control arm in any one of a plurality of positions, said detent assembly comprising a roller mounted for rotation on said control arm, and a coil spring mounted on said frame with the coil axis of the spring substantially parallel to the axis of rotation of said roller, said roller bearing against said spring to deflect one or more coils thereof transversely relative to the coil axis.

2. Apparatus as claimed in claim 1, in which said detent assembly comprises a pair of coil springs mounted side by side on said frame member with the axes of the coils substantially parallel to the axis of rotation of said roller, said roller having a neutral position disposed between said pair of springs and bearing substantially equally against both springs to deflect one or more coils of both springs laterally relative to the coil axes.

3. Apparatus as claimed in claim 1 including an operator-engageable lever operatively connected to said control arm.

4. Apparatus as claimed in claim 1, in which said control arm is movable between a first position wherein the axis of said roller is disposed on a first side of the coil axis, and a second position wherein the axis of said roller is disposed on a second side of the coil axis.

5. A control apparatus comprising a first frame member, a second frame member attached to the first frame member in spaced relation thereto, a shaft rotatably received in said first frame member, a control arm attached to said shaft and disposed between said first and second frame members, and a spring detent assembly acting on said control arm to maintain said control arm in one of a plurality of selected positions, said spring detent assembly comprising first and second coil springs mounted side by side between said first and second frame members with the coil axes parallel to the axis of rotation of said shaft, and a roller rotatably mounted on said control arm with its axis of rotation parallel to the axis of rotation of said shaft, the axis of said shaft being disposed along a line substantially midway between said coil axes, and said roller engaging at least one coil of each of said first and second coil springs and deflecting said at least one coil transversely relative to the coil axis of its respective spring.

6. Apparatus as claimed in claim 5, including an operator-engageable lever operatively connected to said shaft.

7. Apparatus as claimed in claim 5, including stop means engageable with said control arm to limit rotation of said shaft.

8. Apparatus as claimed in claim 5, in which said roller is movable about the axis of rotation of said shaft from a first position wherein the axis of rotation of said roller is disposed substantially at a midpoint between the coil axes of said first and second coil springs, a second position wherein the coil axis of said first spring lies between the axis of rotation of said roller and said midpoint, and a third position wherein the coil axis of said second spring lies between the axis of rotation of said roller and said midpoint.

9. Apparatus as claimed in claim 8, including stop means mounted on said first frame member and engageable with said control arm to limit movement of said roller to a predetermined angular distance from said midpoint.

10. Apparatus as claimed in claim 5, including switch means mounted between said first and second frame members and including switch actuating means engageable by said control arm.

11. Apparatus as claimed in claim 5 in which said first and second coil springs each has a free length greater than the spacing between said first and second frame members.

12. Apparatus as claimed in claim 5, including means engageable with the ends of said first and second coil springs and attached to said first and second frame members to position said springs on said frame members.

13. Apparatus as claimed in claim 12, in which said means engageable with first and second coil springs comprise cup-like members receiving the end coils of said springs and attached to said first and second frame members.

* * * * *

UNITED STATES PATENT AND TRADEMARK OFFICE

CERTIFICATE OF CORRECTION

PATENT NO. : 4,132,128

DATED : January 2, 1979

INVENTOR(S) : George H. Roggenkamp

It is certified that error appears in the above-identified patent and that said Letters Patent are hereby corrected as shown below:

Col. 3, line 1 "34" should read "37".

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*